US006061460A

United States Patent [19]

Seo

[11] Patent Number: 6,061,460

[45] Date of Patent: May 9, 2000

[54] FIXING DEVICE OF SPEAKER UNIT FOR PORTABLE COMPUTER

[75] Inventor: Yeol-Gu Seo, Kyunggl-do, Rep. of Korea

[73] Assignee: SamSung Electronics Co., Ltd., Kyungki-do, Rep. of Korea

[21] Appl. No.: 09/060,466

[22] Filed: Apr. 15, 1998

[30] Foreign Application Priority Data

Apr. 16, 1997 [KR] Rep. of Korea ..... 97-14011

[51] Int. Cl.[7] ..... H04R 25/00

[52] U.S. Cl. ..... 381/388; 381/386; 381/395; 381/387; 181/150

[58] Field of Search ..... 381/388, 386, 381/387, 392, 390, 395, FOR 151, FOR 165; 181/141, 150

[56] References Cited

U.S. PATENT DOCUMENTS

| | | | |
|---|---|---|---|
| 4,535,870 | 8/1985 | Lindsay . | |
| 4,752,962 | 6/1988 | Thiele et al. . | |
| 4,852,178 | 7/1989 | Inkman et al. | 381/205 |
| 4,853,966 | 8/1989 | Skrzycki . | |
| 5,394,479 | 2/1995 | Ishigaya et al. . | |
| 5,400,412 | 3/1995 | King, Sr. et al. . | |
| 5,416,283 | 5/1995 | Dault et al. . | |
| 5,452,365 | 9/1995 | Kalis . | |
| 5,699,438 | 12/1997 | Smith et al. . | |

*Primary Examiner*—Curtis A. Kuntz
*Assistant Examiner*—Suhan Ni
*Attorney, Agent, or Firm*—Robert E. Bushnell, Esq.

[57] ABSTRACT

An apparatus for securing a speaker to a portable computer including a speaker receiving recess adapted to receive a speaker therein and defined by an annular guide rib extending downwardly from a lower surface of a panel of a computer body, a speaker fixing member adapted to cover the speaker receiving recess, thereby upwardly supporting the speaker received in the speaker receiving recess, the speaker fixing member being coupled to the panel by a rotation thereof carried out in a selected left or right direction by a desired angle, and anti-loosening members each extending radially outwardly from the speaker fixing member, each of the anti-loosening members engaging with the lower surface of the panel in a state, in which it rotates in accordance with the rotation of the speaker fixing member, thereby preventing the speaker fixing member from rotating optionally from a state fixing the speaker fixing member. In this fixing device, the fixing of the speaker is achieved by simply rotating a speaker fixing member by a desired angle. No screw is used for the fixing of the speaker. Accordingly, it is possible to simply and conveniently achieve the speaker fixing process. It is also possible to completely avoid a sound trembling phenomenon due to vibrations occurring at coupling portions. Thus, a good quality of sound can be output. The disclosed speaker securing apparatus can be utilized in a desktop computer, portable computer, wall or shelf of a home or office, automobile interior panel, and in other appropriate panels and enclosures.

20 Claims, 6 Drawing Sheets

FIXING DEVICE OF SPEAKER UNIT FOR PORTABLE COMPUTER

CLAIM OF PRIORITY

This application makes reference to, incorporates the same herein, and claims all benefits accruing under 35 U.S.C. § 119 from an application entitled FIXING DEVICE OF SPEAKER UNIT FOR PORTABLE COMPUTER earlier filed in the Korean Industrial Property Office on Apr. 16, 1997, and there duly assigned Serial No.14011/1997, a copy of which is annexed hereto.

BACKGROUND OF THE INVENTION

1. Technical Field

The present invention relates to a securing apparatus of a speaker unit for a portable computer, and more particularly to a securing apparatus of a speaker unit for a portable computer having a configuration capable of more conveniently and simply securing the speaker unit to the portable computer.

2. Related Art

Personal computer systems in general and IBM compatible personal computer systems in particular have attained widespread use. These personal computer systems now provide computing power to many segments of today's modern society. A personal computer system can usually be defined as a desktop, floor-standing, or portable microcomputer that includes a system unit having a system processor with associated volatile and non-volatile memory, a display monitor, a keyboard, one or more floppy diskette drives, a CD-ROM (compact disc read only memory) drive, a hard disk storage device and an optional printer. One of the distinguishing characteristics of these systems is the use of a system board or motherboard to electrically connect these components together. These personal computer systems are information handling systems which are designed primarily to give independent computing power to a single user and are priced for purchase by individuals or small businesses.

Portable computers are often referred to as laptop, notebook, or subnotebook computers. A portable computer typically has a computer body, a keyboard mounted on the computer body, and a display unit hingably mounted to the computer body in such a manner that it is foldable and unfoldable with respect to the computer body. The display unit displays information input as the user manipulates the keyboard.

Recently, auxiliary devices such as CD-ROM (compact disc read only memory) drives and DVD (Digital Video Disk) drives have been incorporated in portable computers having the above mentioned configuration, in order to output, through a display unit, moving picture data and audio data as well as character data. Also, a speaker securing apparatus is also provided at a desired portion of the computer body in order to output audio data.

A conventional speaker securing apparatus incorporated in a portable computer having the above mentioned configuration typically has a speaker receiving recess formed at a desired portion of the bottom of the computer body. A speaker is received in the speaker receiving recess. The speaker is fixedly mounted to the computer body by screws while the speaker is received in position in the speaker receiving recess.

In such a conventional speaker securing apparatus, however, there is a problem in that it is very troublesome to carry out repair or replacement of the speaker because a plurality of screws are used to mount the speaker to the bottom of the computer body.

Furthermore, the coupling degree of the screws may vary depending on the skill of the worker in the process of fixing the speaker. When the screws are loose, the mounted state of the speaker is unstable. In this case, vibrations are generated at the locations of the screws by sound generated from the speaker. As a result, the bottom of the computer body vibrates, thereby causing the sound generated from the speaker to tremble. This results in a poor quality of the generated sound.

Examples of speaker securing devices are disclosed in U.S. Pat. No. 5,452,365 for *Method and Apparatus for Mounting a Speaker Within a Radio* issued to Kails, U.S. Pat. No. 5,699,438 for *Speaker Mounting System* issued to Smith et al., U.S. Pat. No. 5,416,283 for *Drop-in Speaker Mount* issued to Dault et al., U.S. Pat. No. 5,400,412 for *Panel Mount Speaker Support System* issued to King, Sr. et al., U.S. Pat. No. 5,394,479 for *Sounding Apparatus with Surface Mounting Terminals* issued to Ishigaya et al., U.S. Pat. No. 5,319,164 for *Speaker Holder* issued to Shen, U.S. Pat. No. 5,143,339 for *Speaker Mounting Assembly* issued to Ashcraft et al., U.S. Pat. No. 5,048,089 for *Portable Removable Attached Speaker Assembly* issued to Moore, U.S. Pat. No. 4,917,212 for *Speaker Supporting Unit* issued to Iwaya, U.S. Pat. No. 4,887,690 for *Speaker Grille Assembly* issued to Patel, U.S. Pat. No. 4,853,966 for *Speaker Mounting System* issued to Skrzycki, U.S. Pat. No. 4,815,558 for device for *Accomodating a Loudspeaker into a Cut-out of a Sound Panel* issued to Krainhofer, U.S. Pat. No. 4,852,178 for *Speaker Retaining Assembly* issued to Inkman et al., U.S. Pat. No. 4,752,962 for *Loudspeaker Unit with Means for Releasably Fastening Loudspeaker Chassis Is to its Frame* issue to Thiele et al., and U.S. Pat. No. 4,535,870 for *Quick Attach-detach Mechanism for Audio Components* issued to Lindsay.

Although some speaker mounting systems have been developed, I have discovered that it would be desirable to further improve a speaker securing apparatus to enhance vibration control and to reduce chances of damage to the portable computer and to the speaker securing apparatus while the speaker is attached and separated from the portable computer.

SUMMARY OF THE INVENTION

Therefore, an object of the invention is to solve the above mentioned problems involved in the related art and to provide a speaker securing apparatus of a speaker unit for a portable computer having a configuration capable of more conveniently and simply securing the speaker unit to the portable computer and also having a configuration capable of more conveniently and simply separating the speaker unit from the portable computer while preventing a degradation in the quality of sound generated from the speaker unit even after a considerable period of time elapses.

In accordance with the present invention, the above objects are accomplished by providing a fixing device of a speaker unit for a portable computer comprising a speaker receiving recess adapted to receive a speaker therein and defined by an annular guide rib downwardly protruded from a lower surface of a panel included in a body of the portable computer, the speaker receiving recess having a desired depth, a speaker fixing member adapted to cover the speaker receiving recess, thereby upwardly supporting a lower surface of the speaker received in the speaker receiving recess, the speaker fixing member being coupled to the panel by a rotation thereof carried out in a selected left or right direction by a desired angle, and anti-loosening members each extending radially outwardly from a desired portion of the speaker fixing member in such a manner that it is integral with the speaker fixing member, each of the anti-loosening members engaging with the lower surface of the panel in a state, in which it rotates in accordance with the rotation of the speaker fixing member, thereby preventing the speaker fixing member from rotating optionally from a state fixing the speaker fixing member.

In accordance with the principles of the present invention, the speaker fixing member comprises a cap-shaped cover fitted around the guide rib to cover the speaker receiving recess, the cover having a desired depth, an annular speaker support rib extending upwardly from a bottom surface of the cover to a desired height in such a manner that it is concentric with the cover, the speaker support rib serving to upwardly support the lower surface of the speaker received in the speaker receiving recess, a pair of engaging pieces radially outwardly protruded from desired portions of a peripheral edge of the speaker fixing member at an upper end of the speaker fixing member in such a manner that they are radially opposite to each other, each of the engaging pieces having an opening, and a pair of hook pieces each extending downwardly from the lower surface of the panel on a rotating path of an associated one of the engaging pieces, each of the hook pieces being inserted into the opening of the associated engaging piece upon coupling the speaker fixing member to the panel and engaging with the associated engaging piece in accordance with a rotation of the cover.

In accordance with the principles of the present invention, each of the anti-loosening members comprises an elastic piece having an arc shape of a desired angle and extending from an associated one of the engaging pieces in a direction reverse to the coupling direction, the elastic piece being provided, at an outer end thereof spaced away from the associated engaging piece, with an engaging protrusion extending upwardly from an upper surface of the elastic piece to a desired height, and an engaging protrusion extending downwardly from the lower surface of the panel at a desired position, the engaging protrusion engaging with the engaging protrusion of the elastic piece upon a rotation of the elastic piece resulting from the rotation of the cover carried out to fix the speaker.

The present invention is more specifically described in the following paragraphs by reference to the drawings attached only by way of example.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DESCRIPTION OF THE PREFERRED EMBODIMENTS

Figure 1:
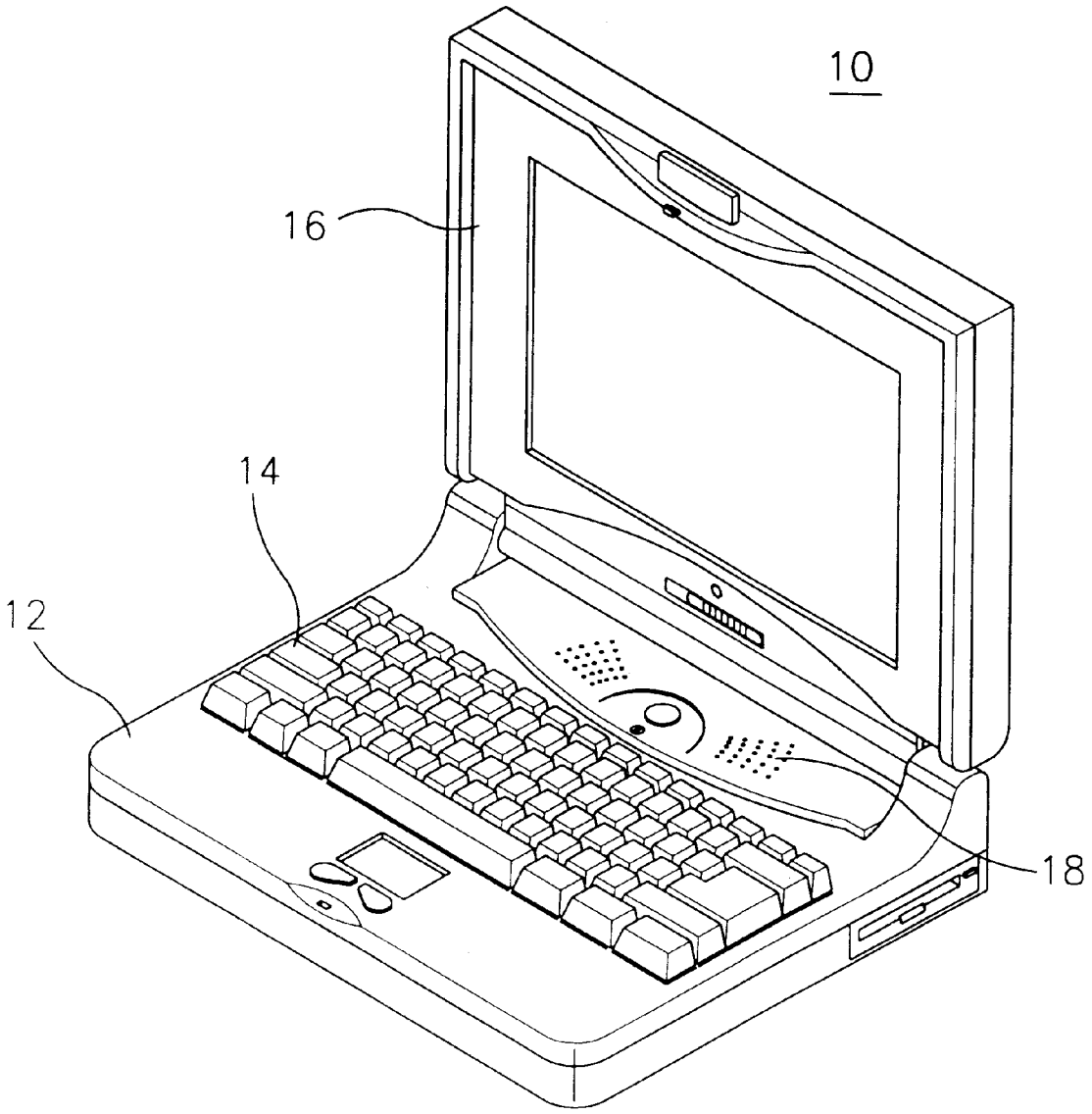
FIG. 1 is a perspective view illustrating a portable computer equipped with a conventional speaker unit.

Refer now to FIG. 1, which is a perspective view illustrating a portable computer equipped with a conventional speaker unit. As shown in FIG. 1, the portable computer, which is denoted by the reference numeral 10, includes a computer body 12, a keyboard 14 mounted on the computer body 12, and a display unit 16 hingably mounted to the computer body 12 in such a manner that it is foldable and unfoldable with respect to the computer body 12. The display unit 16 displays information input as the user manipulates the keyboard 14. Also, a speaker securing unit 18 is also provided at a desired portion of the computer body 12 in order to output audio data.

Recently, auxiliary devices such as CD-ROM (compact disc read only memory) drives and DVD (Digital Video Disk) drives have been incorporated in portable computers having the above mentioned configuration, in order to output, through a display unit such as the display unit 16, moving picture data and audio data as well as character data.

Figure 2:
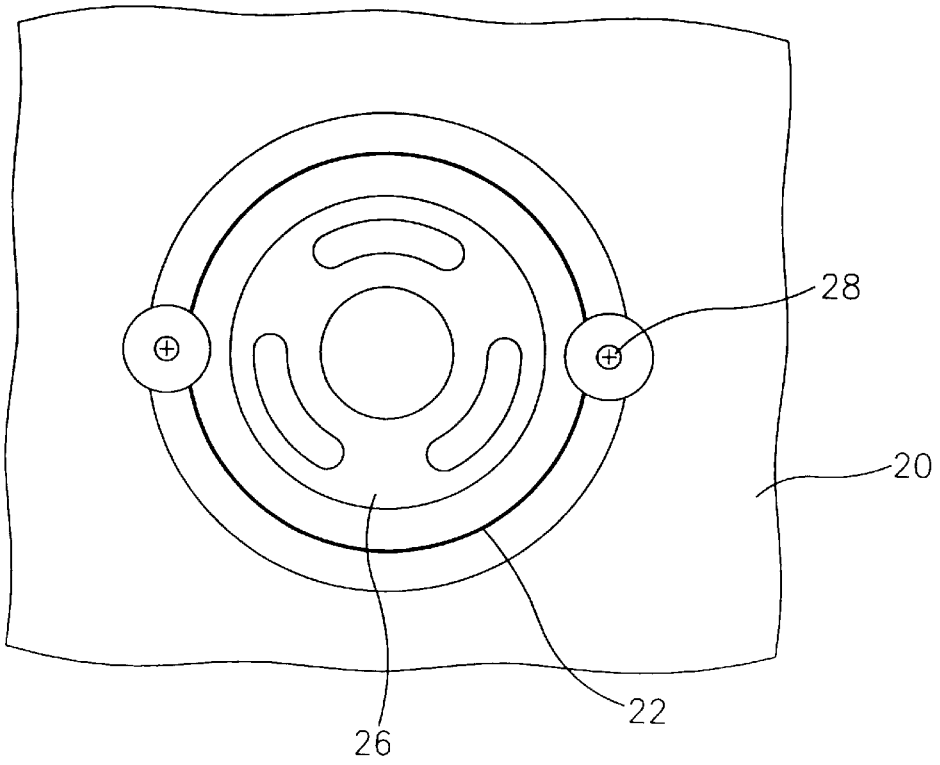
FIG. 2 is a bottom view illustrating a conventional speaker securing configuration used in the portable computer of FIG. 1.
Figure 3:
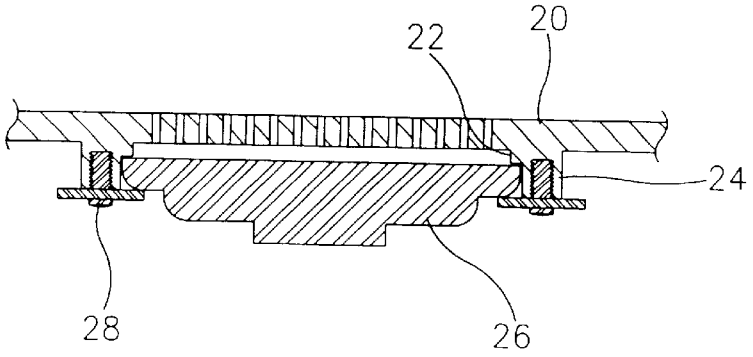
FIG. 3 is a sectional view illustrating the conventional speaker securing configuration used in the portable computer of FIG. 1.

Refer now to FIG. 2, which is a bottom view illustrating a conventional speaker securing configuration used in the portable computer of FIG. 1. Also, refer to FIG. 3, which is a sectional view illustrating the conventional speaker securing configuration used in the portable computer of FIG. 1. As shown in FIGS. 2 and 3, the speaker securing unit, which is denoted by the reference numeral 18, includes a speaker receiving recess 22 formed at a desired portion of the lower surface of a panel 20 included in a computer body 12. A speaker 26 is received in the speaker receiving recess 22. A plurality of coupling bosses 24 are formed at desired portions of the lower surface of the panel 20 each spaced from the outer edge of the speaker receiving recess 22 by a desired distance. The coupling bosses 24 are arranged in pairs while being radially opposite to each other in each pair. The speaker 26 is fixedly mounted to the computer body 12 by coupling screws 28 to the coupling bosses 24 in a state in which the speaker 26 is received in position in the speaker receiving recess 22.

In such a conventional speaker securing unit, however, there is a problem in that it is very troublesome to carry out repair or replacement of the speaker 26 because a plurality of screws 28 are used to mount the speaker 26 to the panel 20 of the computer body 12.

Furthermore, the coupling degree of the screws 28 may vary depending on the skill of the worker in the process of fixing the speaker 26. Where the screws 28 are loosely coupled to the coupling bosses 24, the mounted state of the speaker 26 is unstable. In this case, vibrations are generated at the coupling portions between the screws 28 and coupling bosses 24 by sound generated from the speaker 26. As a result, the panel 20 vibrates at a small altitude, thereby causing the sound generated from the speaker to tremble. This results in a poor quality of the generated sound.

Referring to FIGS. 4 through 8, a securing apparatus of a speaker unit for a portable computer is illustrated, according to the principles of the present invention. Elements in FIGS. 4 through 8 which correspond to elements illustrated in FIGS. 1 to 3 will be denoted by the same reference numerals, respectively.

Figure 4:
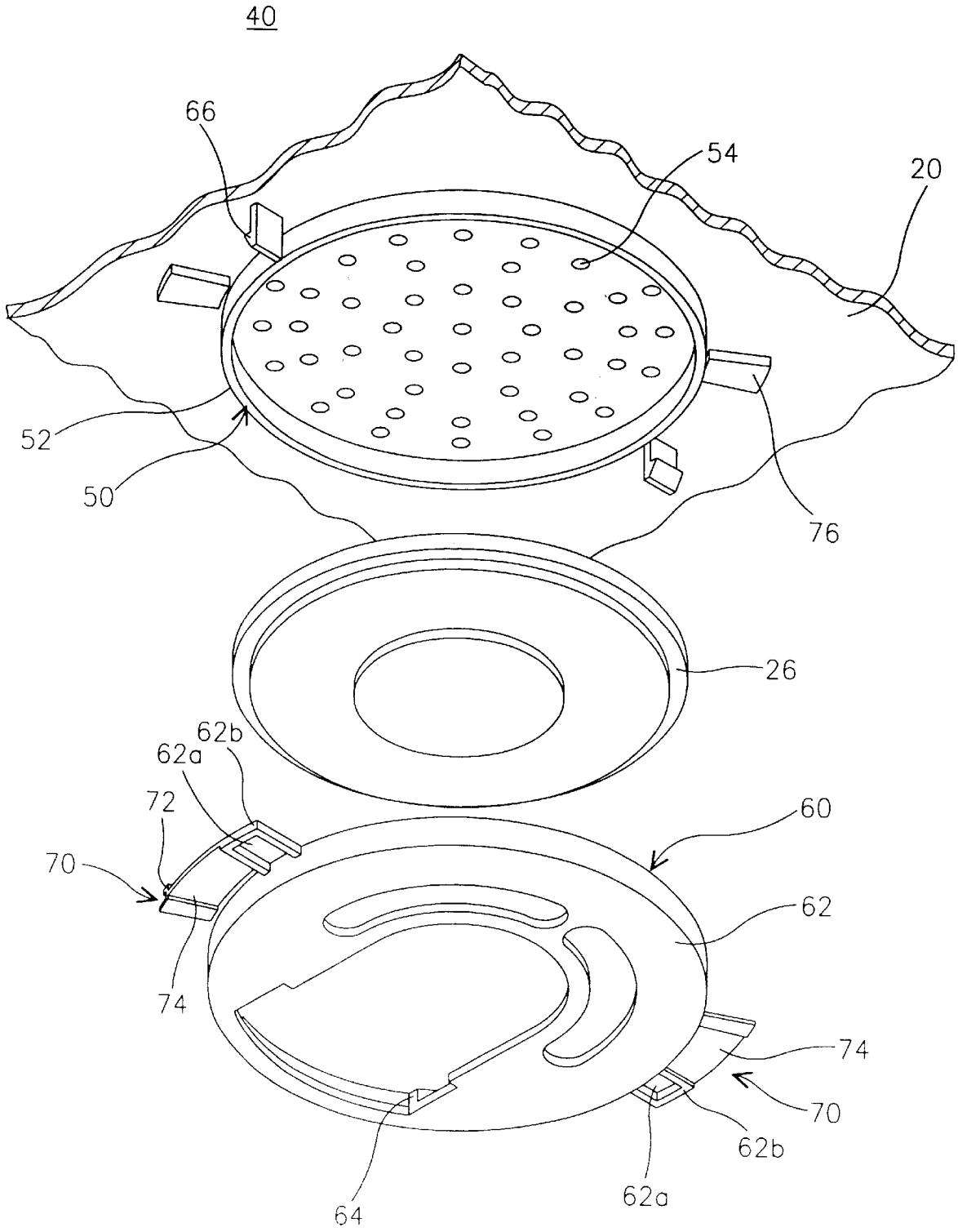
FIG. 4 is an exploded perspective view illustrating a speaker securing device for a portable computer, according to the principles of the present invention.

Refer now to FIG. 4, which is an exploded perspective view illustrating a speaker securing device for a portable computer, according to the principles of the present invention. Also, refer to FIG. 5, which is an enlarged sectional view illustrating the speaker securing device of FIG. 4 assembled with a portable computer, according to the principles of the present invention. The speaker fixing device, which is denoted by the reference numeral 40, includes a speaker receiving recess 50 adapted to receive a speaker 26 therein, a speaker fixing member 60 adapted to support the speaker 26 received in the speaker receiving recess 50 while holding the speaker 26 in position in the speaker receiving recess 50, and anti-loosening members 70 each adapted to prevent the speaker fixing member 60 from accidentally rotating from a state securing the speaker fixing member 60.

In accordance with the principles of the present invention, the speaker receiving recess 50 is defined by an annular guide rib 52 of a desired diameter extending downwardly from a desired portion of the lower surface of a panel 20 included in a computer body 12. The speaker receiving recess 50 has a depth sufficient to completely receive the speaker 26. A plurality of sound emitting holes 54 are formed through the portion of the panel 20 defining the speaker receiving recess 50 in such a manner that they communicate with the outside of the panel 20.

The speaker fixing member 60 is coupled to the lower surface of the panel 20 in order to support the speaker 26 received in the speaker receiving recess 50 beneath the speaker receiving recess 50. The coupling of the speaker fixing member 60 to the panel 20 is achieved by rotating the speaker fixing member 60 in a selected direction, namely, clockwise or counter-clockwise, by a desired angle while causing the upper surface of the speaker fixing member 60 to come into contact with the lower surface of the panel 20.

Each of the anti-loosening members 70 extends radially outwardly from a desired portion of the peripheral edge of the speaker fixing member 60 at the upper end of the speaker fixing member 60 in such a manner that it is integral with the speaker fixing member 60. Each anti-loosening member 70 engages with the lower surface of the panel 20 in a state in which it rotates in a selected direction by a desired angle. The anti-loosening member 70 is configured to prevent the speaker fixing member 60 covering the speaker receiving recess 50 from rotating accidentally in the reverse direction after engaging with the panel 20.

Figure 5:
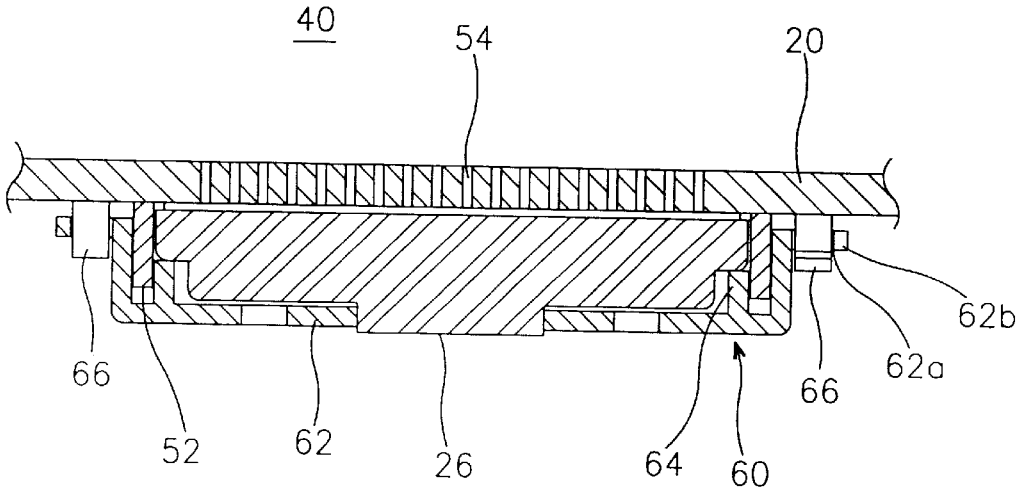
FIG. 5 is an enlarged sectional view illustrating the speaker securing device of FIG. 4 assembled with a portable computer, according to the principles of the present invention.

The speaker fixing member 60 and anti-loosening members 70 included in the speaker fixing device 40 of the present invention will now be described in detail, in conjunction with FIGS. 4 and 5. In accordance with the principles of the present invention, the speaker fixing member 60 includes a cover 62 fitted around the guide rib 52 to cover the speaker receiving recess 50, an annular speaker support rib 64 adapted to support the speaker 26 received in the speaker receiving recess 50, hook pieces 66 extending downwardly from the lower surface of the panel 20, and engaging pieces **62*b* engaging with the hook pieces 66, respectively, thereby coupling the speaker fixing member 60 to the panel 20**.

The cover 62 of the speaker fixing member 60 has the shape of a cap having a desired depth. The speaker support rib 64, which upwardly supports the lower surface of the speaker 26 received in the speaker receiving recess 50, protrudes upwardly from the bottom surface of the cover 62 to a desired height in such a manner that it is concentric with the cover 62 while being spaced from the side wall of the cover 62.

The engaging pieces **62*b* extends radially outwardly from desired portions of the peripheral edge of the speaker fixing member 60 at the upper end of the speaker fixing member 60. Preferably, two engaging pieces 62*b* are arranged in such a manner that they are radially opposite to each other. Each engaging piece 62*b* has an opening 62*a* adapted to receive an associated one of the hook pieces 66 upon coupling the speaker fixing member 60 to the panel 20. Each of the hook pieces 66 extends downwardly from the lower surface of the panel 20 on the rotating path of the associated engaging piece 62*b*. Each hook piece 66, which is inserted into the associated opening 62*a* upon coupling the speaker fixing member 60 to the panel 20, engages with the associated engaging piece 62*b* in accordance with a rotation of the cover 62**.

In accordance with the principles of the present invention, an elastic piece 74 having an arc shape of a desired angle extends from each engaging piece **62*b* in a direction reverse to the coupling direction in such a manner that it is integral with the engaging piece 62*b*. The elastic piece 74 has an secondary engaging protrusion 72 at the outer end thereof spaced away from the engaging piece 62*b*. The secondary engaging protrusion 72 extends upwardly from the upper surface of the elastic piece 74 to a desired height. The panel 20 also has primary engaging protrusions 76 each extending downwardly from the lower surface of the panel at a desired position. Each primary engaging protrusion 76 engages with the secondary engaging protrusion 72 of the associated elastic piece 74 upon a rotation of the elastic piece 74 resulting from a rotation of the cover 62 carried out to secure the speaker 26. The anti-loosening member 70 consists of the elastic piece 74 and secondary engaging protrusion 72**.

Figure 6:
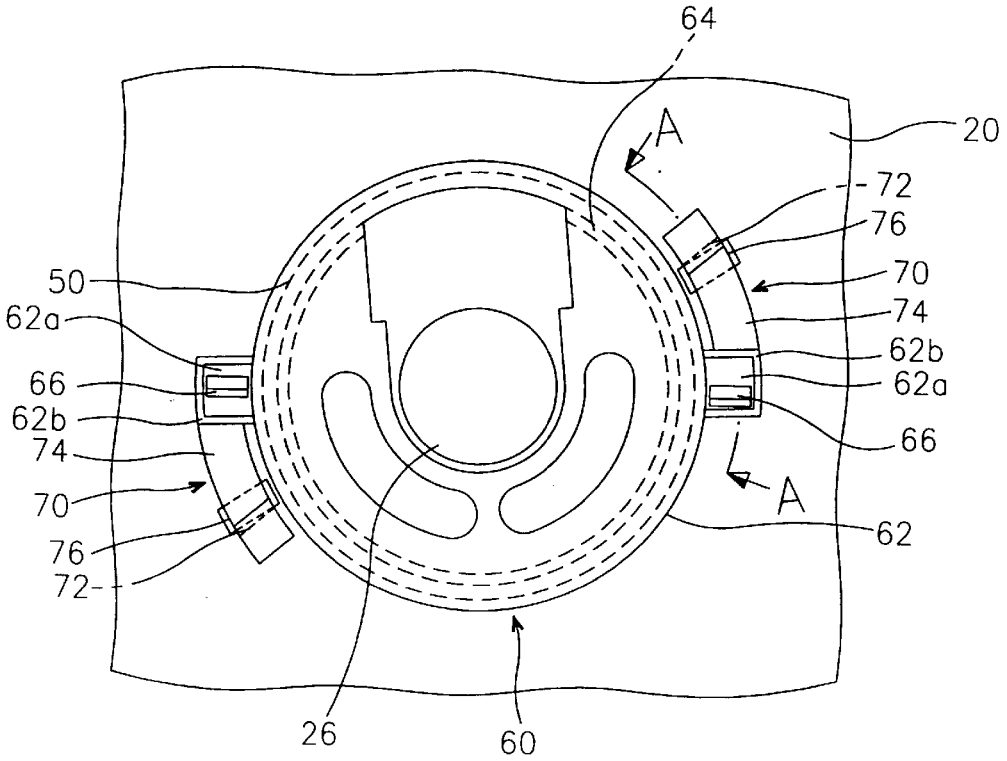
FIG. 6 is a bottom view illustrating an initial step of the process of securing a speaker unit to a computer body using the speaker securing device of FIG. 4, according to the principles of the present invention.

Now, the process for securing the speaker to the portable computer using the speaker fixing device having the above mentioned configuration according to the principles of the present invention will be described. Refer now to FIG. 6, which is a bottom view illustrating an initial step of the process of securing a speaker unit to a computer body using the speaker securing device of FIG. 4, according to the principles of the present invention. Upon fixing the speaker 26 to the portable computer 10, the speaker 26 is first received in the speaker receiving recess 50 defined by the guide rib 52 at the lower surface of the panel 20, as shown in FIG. 6. Thereafter, the cover 62 is fitted around the guide rib 52 beneath the panel 20 in such a manner that the hook pieces 66 protruded from the panel 20 are inserted into the openings **62*a* of the engaging pieces 62*b*, respectively. In this state, the upper end of the speaker support rib 64 supports the lower surface of the speaker 26 while the guide rib 52 defining the speaker receiving recess 50 is fitted between the side wall of the cover 62 and the speaker support rib 64**.

Figure 7:
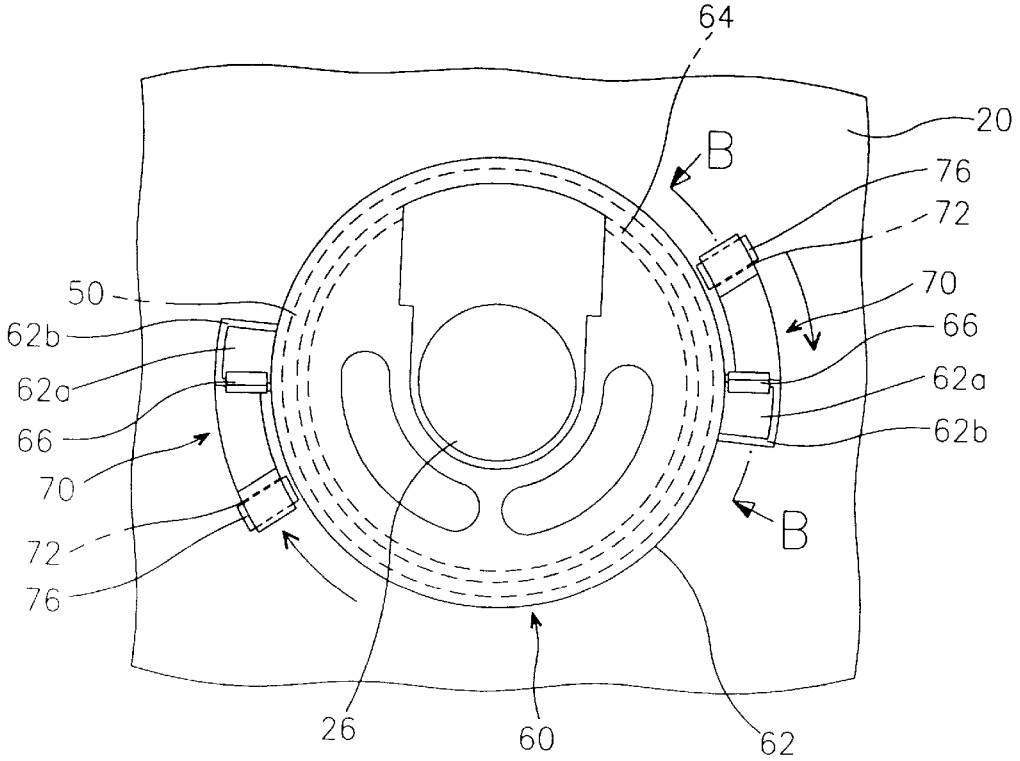
FIG. 7 is a bottom view illustrating a final step of the process of securing a speaker unit to a computer body using the speaker securing device of FIG. 4, where the process is complete, according to the principles of the present invention.

Refer now to FIG. 7, which is a bottom view illustrating a final step of the process of securing a speaker unit to a computer body using the speaker securing device of FIG. 4, where the process is complete, according to the principles of the present invention. When the cover 62 is rotated in a selected direction, namely, clockwise or counter-clockwise, from the state illustrated in FIG. 6 by a desired angle, as shown in FIG. 7, each engaging piece 62*b* of the cover 62 engages with the associated hook piece 66 protruded from the panel 20. At the same time, the secondary engaging protrusion 72 of each elastic piece 74 engages with the associated primary engaging protrusion 76 protruded from the panel 20 in a snapped manner. Thus, the speaker 26 is firmly fixed.

In this state, the cover 62 is prevented from rotating in the reverse direction by virtue of the engagement of the anti-loosening members 70 each consisting of the elastic piece 74 and secondary engaging protrusion 72.

Meanwhile, when the speaker 26 is out of order, it is necessary to separate the cover 62 from the panel 20 for a repair of the speaker in order to repair the speaker 26 or to replace it with a new one. In this case, the user downwardly pulls the outer end of each elastic piece 74 while gripping the outer end by his fingers, the elastic piece 74 is downwardly bent by virtue of its elasticity. Accordingly, the secondary engaging protrusion 72 of the elastic piece 74 disengages from the associated primary engaging protrusion 76. As the user rotates the cover 62 in a direction opposite to the coupling direction in this disengagement state, each engaging piece 62*b* disengages from the associated hook piece 66. When the user downwardly pulls the cover 62 in this state, the cover 62 is separated from the panel 20, thereby causing the speaker 26 to be separated from the speaker receiving recess 50.

Figure 8A:
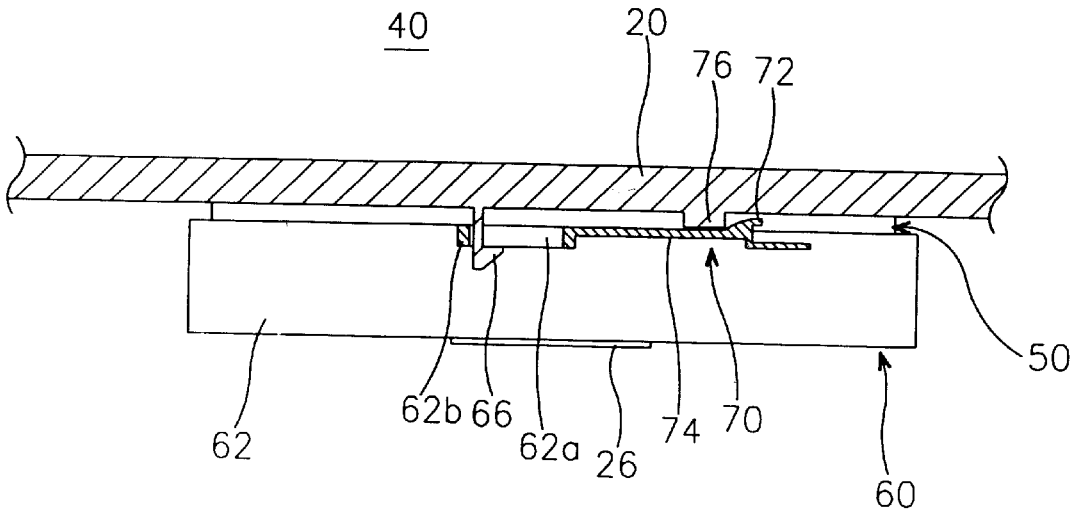
FIG. 8A is a cross-sectional view taken along the line A—A of FIG. 6, illustrating a section of the speaker securing device of FIG. 4, according to the principles of the present invention.
Figure 8B:
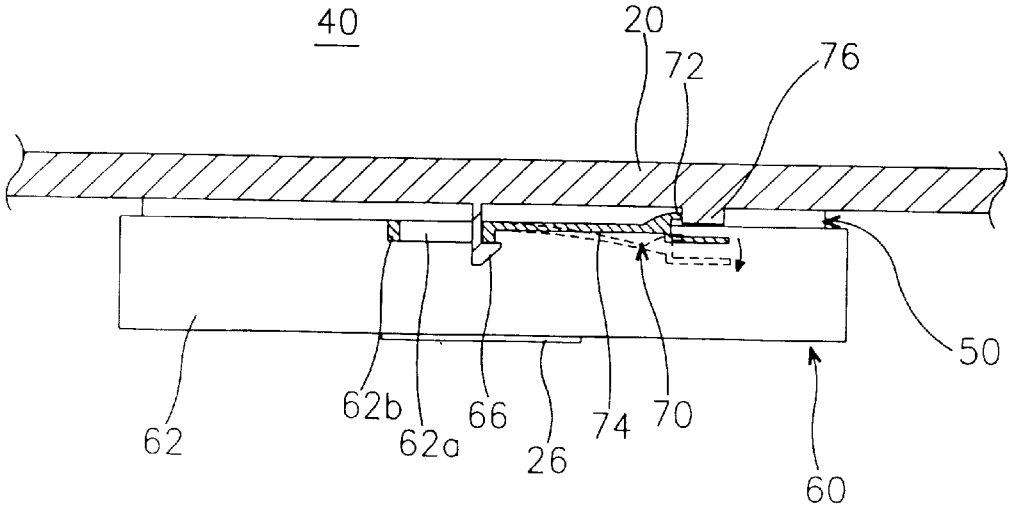
FIG. 8B is a cross-sectional view taken along the line B—B of FIG. 7, illustrating a section of the speaker securing device of FIG. 4, according to the principles of the present invention.

For additional illustrative views of the speaker securing device, according to the principles of the present invention, refer to FIGS. 8A and 8B. FIG. 8A is a cross-sectional view taken along the line A—A of FIG. 6, illustrating a section of the speaker securing device of FIG. 4, according to the principles of the present invention. FIG. 8B is a cross-sectional view taken along the line B—B of FIG. 7, illustrating a section of the speaker securing device of FIG. 4, according to the principles of the present invention.

As apparent from the above description, the present invention provides a fixing device of a speaker unit for a portable computer which achieves the fixing of the speaker by simply rotating a speaker fixing member by a desired angle. In accordance with the present invention, no screw is used for the fixing of the speaker. Accordingly, it is possible to simply and conveniently achieve the speaker fixing process.

In accordance with the present invention, the speaker support rib protruded from the cover of the speaker fixing member uniformly supports the lower surface of the speaker. Accordingly, it is possible to completely avoid a sound trembling phenomenon due to vibrations occurring at coupling portions. Thus, the speaker fixing device enables the speaker to output a good quality of sound.

The foregoing paragraphs describe the details of a securing apparatus of a speaker unit for a portable computer, and more particularly to a securing apparatus of a speaker unit for a portable computer having a configuration capable of more conveniently and simply securing the speaker unit to the portable computer and separating the speaker unit from the portable computer while preventing a degradation in the quality of sound generated from the speaker unit even after a considerable period of time elapses.

The disclosed speaker securing apparatus can be utilized in a desktop computer, portable computer, wall or shelf of a home or office, automobile interior panel, and in other appropriate panels and enclosures.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

What is claimed is:

1. An apparatus securing an audio speaker to a panel, comprising:

a panel having a recessed portion receiving an audio speaker;

an annular guide rib extending outwardly from said panel and defining the recessed portion;

a support unit maintaining said speaker in the recessed portion, mateably engaging said guide rib, said support unit being coupled to said panel when said support unit engages said panel and then is rotated in a first rotational direction by a first predetermined angle, said support unit becoming not coupled to said panel when said support unit is rotated in a second rotational direction by said first predetermined angle, said second rotational direction being opposite to said first rotational direction;

a plurality of hooks extending outwardly from said panel;

a plurality of primary protrusions, extending outwardly from said panel adjacent to said plurality of hooks, each of said plurality of primary protrusions having a top surface facing said support unit and a side surface; and a plurality of securing units, extending radially outwardly from a peripheral edge of said support unit, engaging said plurality of hooks and said plurality of primary protrusions when said support unit is coupled to said panel, and selectively preventing said support unit from becoming not coupled to said panel.

2. The apparatus of claim 1, wherein said support unit further comprises:

a cover unit covering the recessed portion and having a predetermined height; and an annular support rib extending from said cover unit, being concentric with said cover unit, and supporting said speaker.

3. The apparatus of claim 1, wherein said support unit is fully coupled to said panel when said support unit engages said panel and is rotated in said first rotational direction by said first predetermined angle, and said support unit is partly coupled to said panel when said support unit engages said panel and then is rotated in said first rotational direction by a second predetermined angle, said second predetermined angle being less then said first predetermined angle.

4. The apparatus of claim 3, wherein a first securing unit of said plurality of securing units comprises:

a flexible unit having a first end and a second end, said first end defining an aperture receiving a first hook of said plurality of hooks, said flexible unit forming an arc shape extending from the aperture in said second rotational direction; and a secondary protrusion extending from said flexible unit toward said panel, being adjacent to said second end, engaging a first primary protrusion of said plurality of primary protrusions when said support unit is fully coupled to said panel, preventing said support unit from becoming not coupled to said panel when engaging said first primary protrusion, said secondary protrusion having a top surface facing said panel and a side surface.

5. The apparatus of claim 1, wherein said plurality of hooks corresponds to two hooks, said plurality of primary protrusions corresponds to two primary protrusions, and said plurality of securing units corresponds to two securing units.

6. The apparatus of claim 4, wherein said secondary protrusion exists in a resting position not engaging said first primary protrusion when said support unit is not coupled to said panel, said secondary protrusion exists in said resting position engaging said first primary protrusion when said support unit is fully coupled to said panel, said secondary protrusion exists in a flexing position flexing away from said panel and engaging said first primary protrusion when said support unit is partly coupled to said panel, and said flexible unit exists in said flexing position flexing away from said panel when said support unit is becoming not coupled to said panel.

7. The apparatus of claim 6, wherein said top surface of said secondary protrusion engages said top surface of said first primary protrusion when said support unit is partly coupled to said panel, and said side surface of said secondary protrusion engages said side surface of said first primary protrusion when said support unit is fully coupled to said panel.

8. The apparatus of claim 4, wherein said first end of said flexible unit receives said first hook into the aperture of said flexible unit when said support unit is partly coupled to said panel, and said first end of said flexible unit engages said first hook when said support unit is fully coupled to said panel.

9. An apparatus securing an audio speaker to a panel, comprising:

a panel having a recessed portion receiving an audio speaker;

a guide rib extending outwardly from said panel and defining the recessed portion;

a support unit maintaining said speaker in the recessed portion, mateably engaging said guide rib, said support unit being coupled to said panel when said support unit engages said panel and then is moved in a first direction by a first predetermined distance, said support unit becoming not coupled to said panel when said support unit is moved in a second direction by said first predetermined distance, said second direction being opposite to said first direction;

a plurality of hooks extending outwardly from said panel;

a plurality of primary protrusions, extending outwardly from said panel adjacent to said plurality of hooks, each of said plurality of primary protrusions having a top surface facing said support unit and a side surface; and a plurality of securing units, extending outwardly from a peripheral edge of said support unit, engaging said plurality of hooks and said plurality of primary protrusions when said support unit is coupled to said panel, and selectively preventing said support unit from becoming not coupled to said panel.

10. The apparatus of claim 9, wherein said support unit further comprises:

a cover unit covering the recessed portion and having a predetermined height; and a support rib extending from said cover unit and supporting said speaker.

11. The apparatus of claim 9, wherein said support unit is fully coupled to said panel when said support unit engages said panel and is moved in said first direction by said first predetermined distance, and said support unit is partly coupled to said panel when said support unit engages said panel and then is moved in said first direction by a second predetermined distance, said second predetermined distance being less then said first predetermined distance.

12. The apparatus of claim 11, wherein a first securing unit of said plurality of securing units comprises:

a flexible unit having a first end and a second end, said first end defining an aperture receiving a first hook of said plurality of hooks, said flexible unit extending from the aperture in said second direction; and a secondary protrusion extending from said flexible unit toward said panel, being adjacent to said second end, engaging a first primary protrusion of said plurality of primary protrusions when said support unit is fully coupled to said panel, preventing said support unit from becoming not coupled to said panel when engaging said first primary protrusion, said secondary protrusion having a top surface facing said panel and a side surface.

13. The apparatus of claim 9, wherein said plurality of hooks corresponds to two hooks, said plurality of primary protrusions corresponds to two primary protrusions, and said plurality of securing units corresponds to two securing units.

14. The apparatus of claim 12, wherein said secondary protrusion exists in a resting position not engaging said first primary protrusion when said support unit is not coupled to said panel, said secondary protrusion exists in said resting position engaging said first primary protrusion when said support unit is fully coupled to said panel, said secondary protrusion exists in a flexing position flexing away from said panel and engaging said first primary protrusion when said support unit is partly coupled to said panel, and said flexible unit exists in said flexing position flexing away from said panel when said support unit is becoming not coupled to said panel.

15. The apparatus of claim 14, wherein said top surface of said secondary protrusion engages said top surface of said first primary protrusion when said support unit is partly coupled to said panel, and said side surface of said secondary protrusion engages said side surface of said first primary protrusion when said support unit is fully coupled to said panel.

16. The apparatus of claim 12, wherein said first end of said flexible unit receives said first hook into the aperture of said flexible unit when said support unit is partly coupled to said panel, and said first end of said flexible unit engages said first hook when said support unit is fully coupled to said panel.

17. An apparatus securing an audio speaker to a panel, comprising:

a panel having a recessed portion receiving an audio speaker;

a plurality of protrusion units attached to said panel, said plurality of protrusion units being not movable and being not threaded;

a support unit maintaining said speaker in the recessed portion, said support unit being coupled to said panel when said support unit engages said panel and then is moved in a first direction by a first predetermined distance; and a plurality of securing units, extending outwardly from a peripheral edge of said support unit, engaging said plurality of protrusion units when said support unit is coupled to said panel, preventing said support unit from becoming not coupled to said panel when said plurality of securing units is in a locking position engaging said plurality of protrusion units, and allowing said support unit to become not coupled to said panel when said plurality of securing units is in a releasing position not engaging said plurality of protrusion units.

18. The apparatus of claim 17, wherein said plurality of protrusion units further comprises:

a plurality of hooks extending outwardly from said panel engaging said plurality of securing units; and a plurality of primary protrusions engaging said plurality of securing units when said support unit is coupled to said panel, said plurality of primary protrusions extending outwardly from said panel adjacent to said plurality of hooks, each of said plurality of primary protrusions having a top surface facing said support unit and a side surface.

19. The apparatus of claim 18, wherein a first securing unit of said plurality of securing units comprises:

a flexible unit having a first end and a second end, said first end defining an aperture receiving a first hook of said plurality of hooks, said flexible unit extending from the aperture in said second direction; and a secondary protrusion extending from said flexible unit toward said panel, being adjacent to said second end, engaging a first primary protrusion of said plurality of primary protrusions when said support unit is coupled to said panel, preventing said support unit from becoming not coupled to said panel when engaging said first primary protrusion, allowing said support unit to become not coupled to said panel when not engaging said first primary protrusion, said secondary protrusion having a top surface facing said panel and a side surface.

20. The apparatus of claim 19, wherein said top surface of said secondary protrusion engages said top surface of said first primary protrusion when said support unit is being coupled to said panel, and said side surface of said secondary protrusion engages said side surface of said first primary protrusion when said support unit is coupled to said panel.

* * * * *